United States Patent [19]

Hardwick et al.

[11] 4,351,485

[45] Sep. 28, 1982

[54] SHREDDING MACHINES

[76] Inventors: John P. Hardwick, Crewe; Michael J. Pezet, Quorn, both of England; Asadollah A. Sarvestany, Tehran, Iran; Dayananda Satharasinghe, Singapore, Singapore

[21] Appl. No.: 190,314

[22] PCT Filed: Jul. 4, 1979

[86] PCT No.: PCT/GB79/00112

§ 371 Date: Mar. 5, 1980

§ 102(e) Date: Mar. 4, 1980

[87] PCT Pub. No.: WO80/00128

PCT Pub. Date: Feb. 7, 1980

[30] Foreign Application Priority Data

Jul. 5, 1978 [GB] United Kingdom ..... 28952/78

[51] Int. Cl.[3] ..... B02C 25/00

[52] U.S. Cl. ..... 241/36; 241/236; 241/285 B

[58] Field of Search ..... 241/189 R, 190, 236, 241/235, 285 R, 36, 285 A, 33, 285 B

[56] References Cited

U.S. PATENT DOCUMENTS

| | | | |
|---|---|---|---|
| 3,587,983 | 6/1971 | Heinrich | 241/189 R X |
| 3,677,478 | 7/1972 | Schutte | 241/285 B X |
| 4,034,918 | 7/1977 | Culbertson et al. | 241/36 |

FOREIGN PATENT DOCUMENTS

| | | | |
|---|---|---|---|
| 2338654 | 2/1975 | Fed. Rep. of Germany | 241/236 |
| 2531706 | 9/1976 | Fed. Rep. of Germany . | |
| 2220307 | 10/1974 | France | 241/236 |
| 1310057 | 3/1973 | United Kingdom . | |
| 1589214 | 5/1981 | United Kingdom . | |

*Primary Examiner*—Mark Rosenbaum

*Attorney, Agent, or Firm*—Diller, Ramik & Wight

[57] ABSTRACT

In a shredding machine having contra-rotating cutter shafts (16,17) carrying cutters (18), one shaft (16) is at a lower level than the other and the side of the shredding chamber (12) alongside the lower shaft has an ejection chute (71) for intractable material. The chute is normally closed by an access door (74), which when open allows the intractable material to be ejected by reversal of the lower shaft (16). The feed hopper (13) has internal doors (80,81) movable to position obstructing the feed when intractable material is to be cleared from the cutters. An automatic, sequential control system is preferably provided for opening and closing the access door and hopper doors in conjunction with a reversing sequence for the cutters.

9 Claims, 7 Drawing Figures

78
77
83
83
79
13
85
15
87
87
19
86
90
76
II
20
90
II
14
26
75
74
70
17
73
28
71
18
16
72
10
18
11
12

SHREDDING MACHINES

This invention relates to rotary shredding machines of the kind (hereinafter referred to as a "machine of the kind hereinbefore specified") having a comminuting chamber, a pair of parallel cutting shafts extending through the chamber, disc-like cutters on the shafts in said chamber, drive means for driving said shafts in simultaneous contra-rotation, and a feed hopper above the comminuting chamber for feeding material to the cutters, the cutters on one shaft being interleaved with those on the other so that said material is comminuted by the cutters in a cutting zone lying between the said shafts.

Although machines of the above kind are normally referred to as shredding machines or shredders, their comminuting action takes a form or forms which depend largely on the nature of the material being comminuted, and on the design of the cutters. The latter may in practice perform very little cutting as such; for example, glass will tend to be crushed into small pieces, whilst other common materials, such as thin metal, will tend to be torn and/or deformed by crushing. The material to be comminuted is most usually scrap or waste material, though shredders can be used to break up solid materials as part of, or in preparation for, industrial processes of various kinds.

Various types of shredding machine of the kind hereinbefore specified are in commercial use or have been proposed.

The specification of our co-pending British patent application No. 34262/76 describes shredding machines within the aforementioned definition of kind, in which an automatically disengageable clutch is interposed in the drive mechanism, and in which those working components directly or indirectly controlled by the clutch are so constructed that they will not fail under their own or each other's inertia effects when subject to so-called "crash-stop" conditions, e.g. when so-called tramp material in the form of an intractable object is encountered by the cutters which cannot comminute the tramp material.

It is well known to provide a shredder with an automatic reversing facility, whereby under crash-stop conditions, or under conditions of cutter obstruction less severe than this, e.g. when a particularly tough piece of material is nevertheless capable of being comminuted by the cutters, rotation of the cutters is momentarily halted and reversed through a short distance, after which forward rotation is resumed. Typically the machine has a control system such that this reversal may be repeated several times, but also so that, if the tough piece of material has still not been dealt with by the cutters, the machine can be stopped. The offending piece of material can then be removed, usually by hand through the hopper. In a machine of the kind described in our said specification No. 34262/76, the clutch will disengage when the torque imposed by resistance to material being handled reaches a certain predetermined value, but in many instances this torque need not reach that value where one or more reversals will suffice to deal with a "difficult" piece of material. The machine is therefore preferably arranged so that a series of reversals can take place and so that the clutch only disengages if either this is unsuccessful in clearing the obstruction, or the tramp material imposes a force on the cutters such that a torque of at least the abovementioned predetermined value is immediately imposed on the clutch.

Where a clutch or other suitable torque-limiting device is not provided, the control system will be so arranged that the drive motor is stopped.

Arrangements for recirculating material within the comminuting chamber, so as to enable the material to be passed through the cutting zone several times until it has been comminuted into sufficiently small pieces, have also been proposed. One such arrangement is described in British Patent Specification No. 1,310,057, in which the cutter shafts of a machine, which is generally of the kind hereinbefore specified, have their axes in a common plane inclined to the horizontal, the comminuting chamber being so designed that, after passing through the cutting zone any material still not small enough to pass through a series of openings in the bottom of the chamber is urged downwardly below, and then around, the lower of the two cutter assemblies, to pass once again, or repeatedly, through the cutters. No provision is, however, made for dealing with tramp material which cannot pass through the cutting zone in the first place. In the machine described in Specification No. 1,310,057, the cutter shafts both rotate at the same speed as each other.

Despite the possibility of protecting the machine against damage due to intractable tramp material, typical examples of which are iron bars or thick telephone directories, there remains a need to remove tramp material so that normal operation of the machine can be resumed. Tramp material means, in general, any material too large, hard or dense for the cutters to be able to comminute it, and includes intractable objects such that, if they are allowed to enter the cutting zone, they will cause a crash stop to take place. Various proposals for dealing with this problem have been made in the case of disintegrators of the kind in which a single rotor, having a series of relatively large arms which define between each arm and the next a segmental space of substantial radial depth. The arms of the single rotor comminute material by forcing it against a stationary surface or surfaces. In such machines, tramp material can be swept by the arms through, or at least into, that part of the machine in which comminution takes place. This solution is possibl because the segmental spaces mentioned above are in general large enough to accommodate an intractable object, so that the latter does not need to interfere with the comminution of other material and can be kept out of the relatively narrow gap between a rotor arm and the above-mentioned stationary surface.

In the case of a double-shaft machine of the kind to which the present invention relates, such a solution is not possible because in the cutting zone, the cutters are interleaved. There is no physical space for intractable objects in this zone, and it is therefore desirable to try to divert such objects before they are able to cause a crash stop.

According to the invention, in a machine of the kind hereinbefore specified, the axes of the cutter shafts lie in a common plane inclined to the horizontal, the comminuting chamber having, in a side thereof nearest to the lower of the cutter shafts, a chute terminating adjacent the cutters of that shaft and an openable access door for closing the chute, the said inclination being sufficiently steep to facilitate diversion of intractable objects, fed from the hopper, towards the chute and away from the cutting zone. Tramp material can thus be removed through the chute, which may consist of a simple opening in the chamber wall but which preferably has a floor extending inwardly from the latter, and which is preferably inclined downwards away from the cutters. Material fed to the cutters for comminution tends to fall on to the lower cutters, being then forced between the lower cutters and those of the higher shaft by rotation of the former. Under crash-stop conditions, however, when the shafts stop or are reversed, tramp material will tend to fall or be urged by the lower cutters, outwardly towards the chute so that the tramp material can readily be removed.

The hopper preferably has at least one internal hopper door movable between a first position clear of the path of material towards the cutters and a second position in which to obstruct said path at least partially, and actuating means for maintaining said hopper door or doors in said positions and for effecting the movement thereof. This enables the supply of material to the cutters to be reduced at least to a rate such that removal of tramp material is not hindered by new material falling on the cutters whilst they are not in a condition to handle it.

Preferably, the actuating means is external of the hopper and includes an actuating element connected to the or each hopper door through a further element movable in a through slot formed in a wall of the hopper and carrying a movable shutter obturating the slot ahead of the hopper door.

The machine is preferably arranged to deal with tramp material automatically, and to this end in a preferred arrangement according to the invention the access door has further actuating means, the machine including control means responsive to the presence of an intractable object above the cutting zone for operating the hopper door actuating means and then the access door actuating means and for effecting reversal of the cutter shafts, whereby such object can be thrown by the cutters of the lower shaft out through said chute.

Preferably, the drive means are arranged to drive the lower cutter shaft faster than the other cutter shaft.

Embodiments of the invention will now be described, by way of example only, with reference to the drawings hereof, in which.

Figure 1:
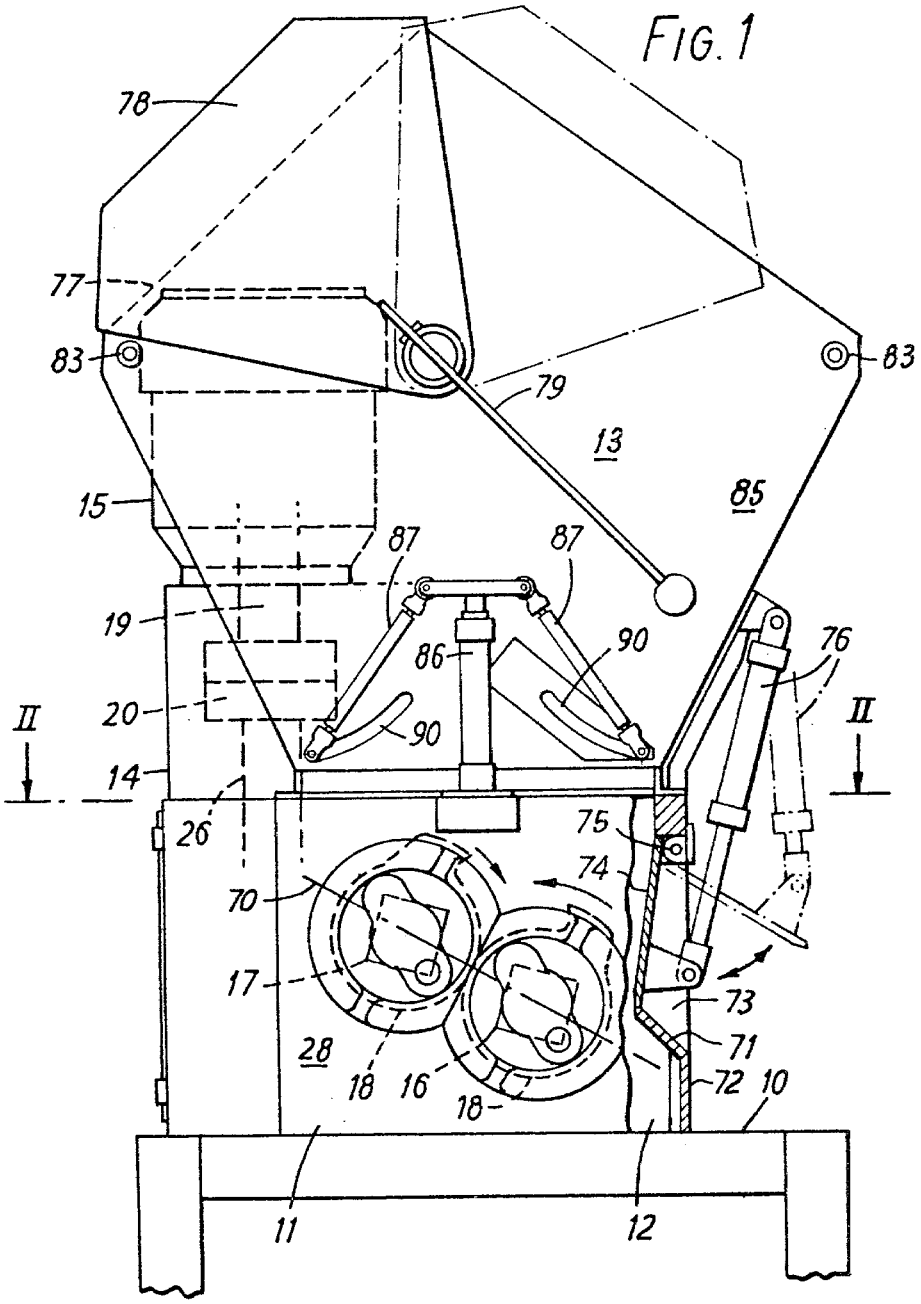
FIG. 1 is a simplified side elevation of a rotary shredding machine, as seen from the bottom end of FIG. 2 but partly in section on the line I—I in FIG. 2.
Figure 2:
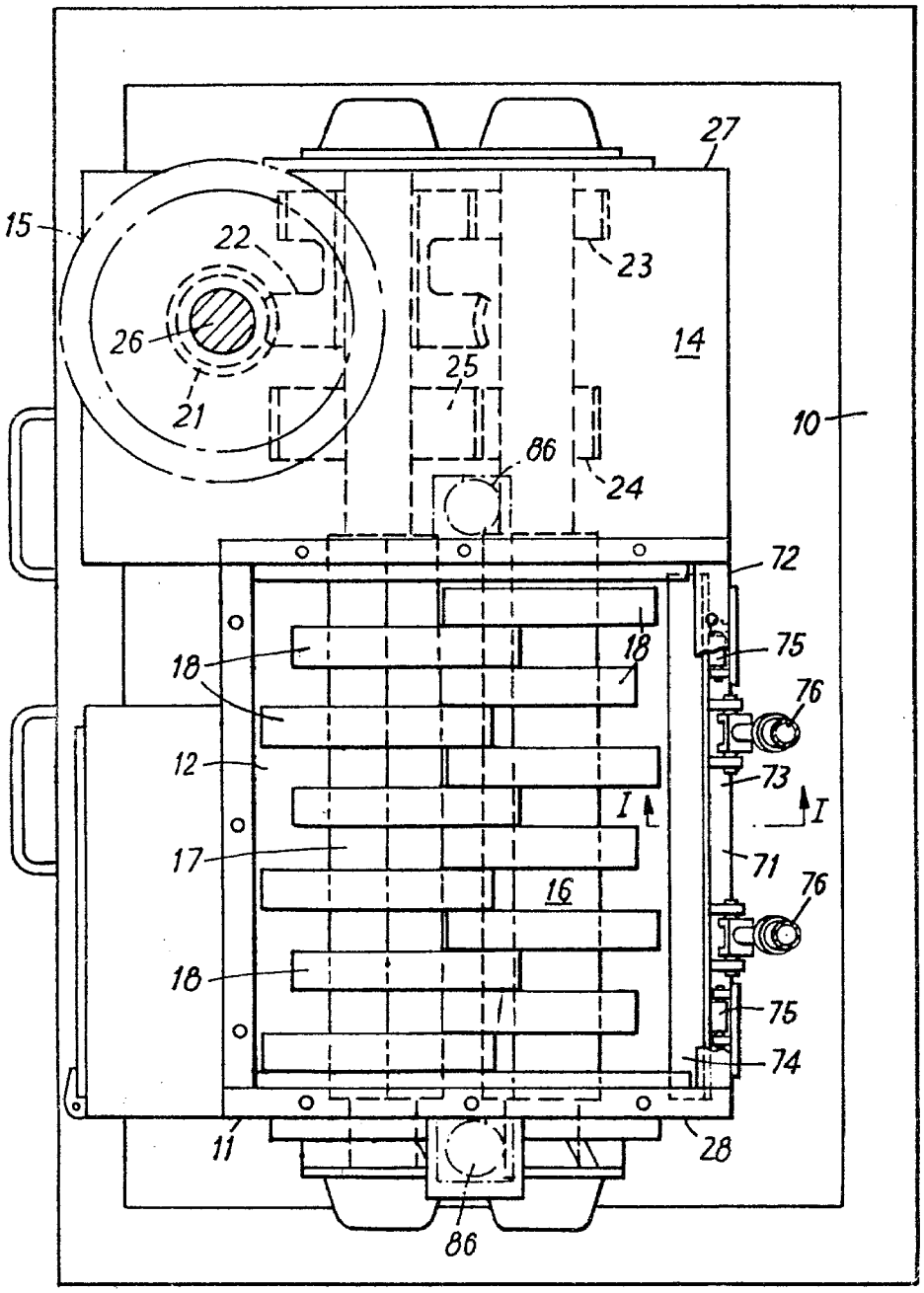
FIG. 2 is a plan view taken on the line II—II in FIG. 1.
Figure 3:
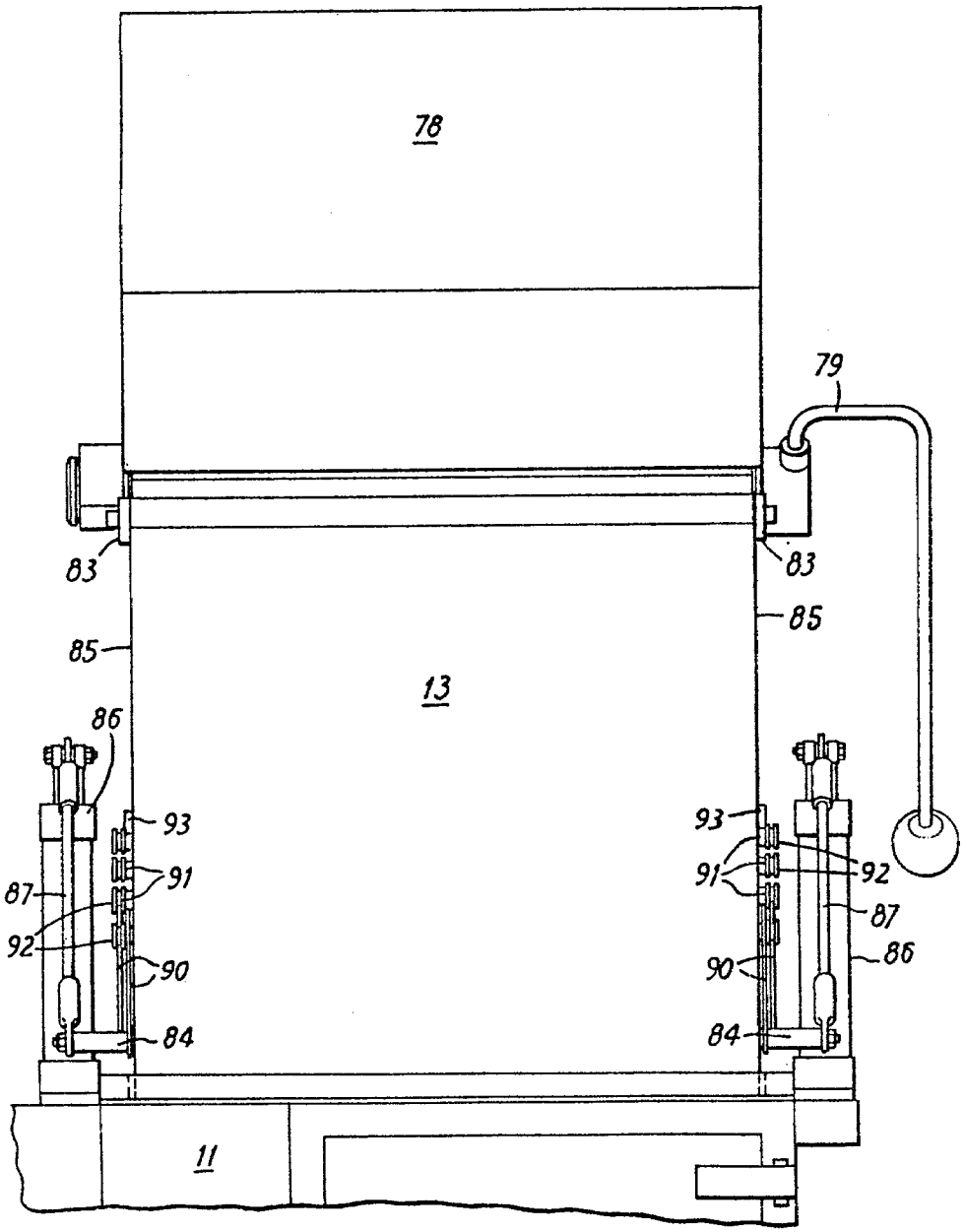
FIG. 3 is an elevation of a hopper of the machine, as seen from the left hand side of FIG. 1 but on a larger scale.

The shredding machine (shredder) shown in FIGS. 1 and 2 has a base frame 10 on which are mounted a cutter box 11 and a gearbox 14. The cutter box 11 encloses a rectangular comminuting chamber 12 which is open at top and bottom. A loading hopper 13 is fixed on top of the cutter box 11. Extending through the chamber 12 and gearbox 14 are a pair of parallel cutter shafts 16,17. A motor 15, mounted on the gearbox 14, has a shaft 19 driving a clutch 20, whose driven shaft 26 carries a worm 21 which drives a worm wheel 22 carried on, but rotatable independently of, the cutter shaft 17. The wheel 22 drives the cutter shaft 16 through a pinion 23 on the latter, whilst the cutter shaft 17 is driven by a pinion 24 on the shaft 16 through a gear 25 on the shaft 17 so that the latter is rotated in the opposite direction to the shaft 16, as indicated by the arrows in FIG. 1, and at a slower speed.

The shredder is preferably constructed according to the principles described in our co-pending British patent application No. 34262/76 aforementioned.

Each of the cutter shafts 16,17 is mounted in end bearings in the opposite end walls 27,28, and also a bearing in a centre plate (not shown), of the gearbox and cutter box respectively, and that part of each cutter shaft that extends through the cutter box is of square cross-section as indicated in FIG. 1. Each shaft 16,17 carries six disc-like cutters 18 which are secured on the shafts, each cutter having a single radial tooth and being spaced by an equal amount from the next such that the cutters of the shaft 16 are interleaved with those of the contra-rotating shaft 17, so as to co-operate with them in comminuting material fed from the hopper 13 into the chamber 12. The comminuting action takes place in a cutting zone which is the zone, intersected by a common plane 70 of the axes of the shafts 16,17, in which the teeth of the interleaved cutters overlap each other, as seen in FIG. 2.

The common plane 70 is inclined to the horizontal at an angle of about 30 degrees, so that the faster shaft 16 lies at a lower level than the slower shaft 16. The comminuting chamber 12 has, in its side nearest to the lower shaft 16, a chute 71 which is formed in the corresponding side wall 72 of the cutter box. The chute 71 is inclined downwardly away from the cutters 18 on the shaft 16 and towards the outside of the cutter box, the wall 72 of the latter having an ejection opening 73 above the chute. The chute 71 terminates adjacent to the cutters 18 of shaft 16. The opening 73 is closed by an access door 74, hinged at the top by means of pivots 75 and coupled to a pair of pneumatic or hydraulic actuators 76 which are pivoted to one side of the hopper 13. The door 74 is inclined towards and downwards as shown, so that in its closed position it prevents material falling from the hopper on to the chute 71.

Figure 6:
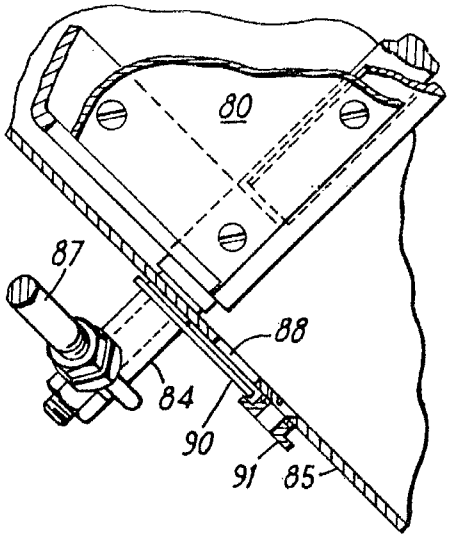
FIG. 6 is an enlarged scrap section taken on the line VI—VI in FIG. 4.
Figure 4:
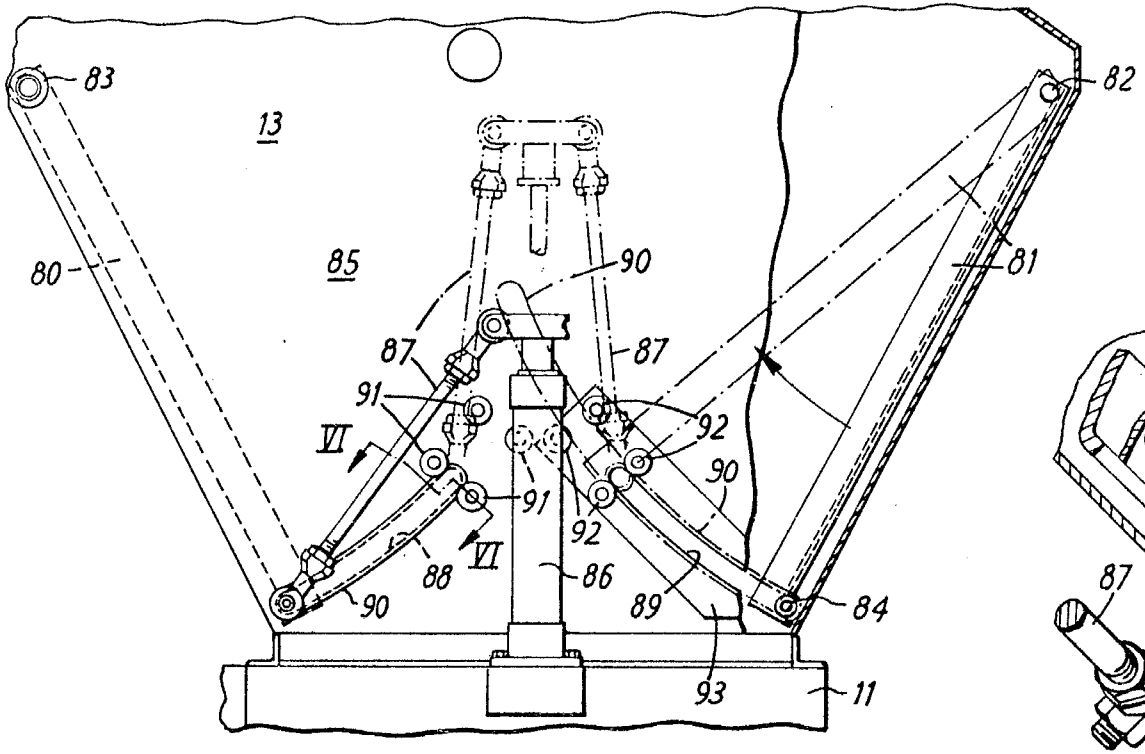
FIG. 4 is an enlarged detail view, partly cut away, taken from FIG. 1.
Figure 5:
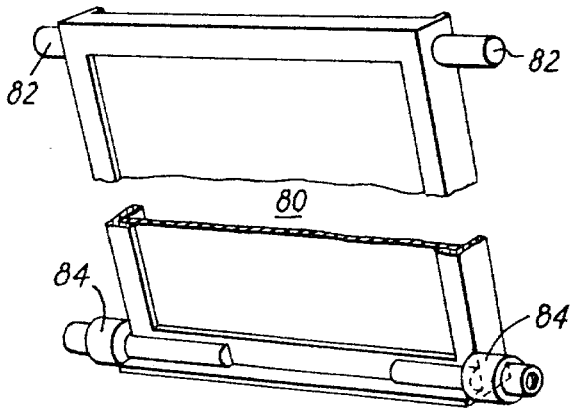
FIG. 5 is a cut-away perspective view of a hopper door of the machine.

The hopper 13 has a feed port 77 closeable by a hood 78 which can be opened by means of a handle 79. Referring now to all of FIGS. 1 to 6, at either side of the hopper is one of a pair of identical, internal hopper doors 80,81 (FIG. 4). The door 80 is shown in FIG. 5. Each hopper door consists of a simple flat plate carried by a frame which has at its upper end a pair of trunnions 82 by which it is pivoted, as indicated at 83, in the end walls 85 of the hopper 13. At the lower end of each door 80,81 is a further pair of trunnions 84 each of which is slidable along an arcuate slot 88 formed through the respective end wall 85 of the hopper. The latter is shown partly cut away in FIG. 4. Carried by the cutter box 11, outside the hopper end walls 85, is actuating means for the hopper doors in the form of a pair of vertical pneumatic or hydraulic jacks 86, each having pivoted at its top end a pair of actuating elements in the form of links 87. Each link 87 is pivoted at its other end to a respective one of the four lower trunnions of the hopper doors, as is best seen in FIG. 6.

In the normal position of the hopper doors 80,81 and of their jacks 86 (as shown in FIGS. 1 and 4) the former lie against the sides of the hopper, clear of the path of material from the hopper towards the cutters. In this position the jacks 86 are in their retracted condition; but when they are raised, the links 87 draw the trunnions 84 along the slots 88,89 so as to move the hopper doors 80,81 to the partially closed position which is indicated in respect of the door 81, in chain-dotted lines in FIG. 4. In this position the hopper doors obstruct the free flow of material downwards on to the cutters 18.

Each trunnion 84 has fixed to it an arcuate shutter 90 (the shutter 90 associated with the slot 89 in FIG. 4 being indicated only by chain-dotted lines so as to reveal the slot). Each shutter 90 obturates the associated slot ahead of the hopper door, i.e. ahead of the corresponding trunnion 84, and is guided by pairs of fixed roller guides 91,92 associated with the slots 88,89 respectively. The position of the shutter 90 of the hopper door 81 when the latter is in its partially-closed position is indicated in phantom lines in FIG. 4, from which it can be seen that in this position the shutters at each end of the hopper overlap each other. To accommodate this overlap, each slot 89 is formed in a plate 93 so that the associated shutter 90 and shutter guides 92 of the door 81 stand further from the hopper end wall 85 than do the shutter and guides of the door 80.

In normal operation, the cutters 18 are rotated as indicated in FIG. 1, with the hopper doors 80,81 open and the access door 74 closed, and material to be comminuted is fed down on to the cutters from the hopper 13, to be broken up by the cutters in known manner and discharged through the open bottom of the chamber. Because of the inclination of the plane 70, heavy objects such as iron bars may roll or fall downwards towards the door 74, thus being diverted harmlessly away from the cutting zone, despite the fact that the cutters on shaft 16 are rotating in the opposite direction. If this does not happen, however, such an object will cause an abnormal force to be experienced by one or more of the cutters 18. If this condition is a "crash-stop" the clutch 20 disengages automatically and the hopper doors 80,81 can then be closed and the access door 74 opened. The tramp material causing the crash stop condition can then be removed manually or by reversal of the cutter shafts; either manually or under power under control of a suitable, generally conventional control system such as to permit reversal of the cutters. If the abnormal condition is less serious than a crash stop, the above-mentioned control system is arranged to effect a predetermined number of reversals of rotation in an attempt to clear the obstruction. It is preferably arranged to do this without the access door 74 being opened, although it may advantageously be arranged so that, under these conditions, it closes the hopper doors 80,81 so as to restrict entry of further material until the obstruction has been cleared by thus diverting the intractable object towards the chute 71 and away from the cutting zone.

The machine can alternatively be arranged for automatic ejection of tramp material, and to this end the machine preferably includes a control system which is responsive to the presence of an intractable object above the cutting zone, i.e. on the entry thereto, and which applies certain predetermined criteria as to whether or not the object is "intractable" for this purpose. Such a control system, if provided, will then operate first the hopper door jacks 86 to effect partial closing of the hopper doors 80,81, and will then open the access door 74 to allow the offending object to be ejected or removed. The same control system will control reversing of the cutter shafts for the purposes of, first, attempting to comminute the object, and then, if this is unsuccessful, attempting to reject it through the opening 73. Such a control system may be designed, in the light of the foregoing description, applying well-known machine control techniques. However, by way of example only, principal elements of one simple scheme for such a control system is shown diagrammatically in FIG. 7.

Figure 7:
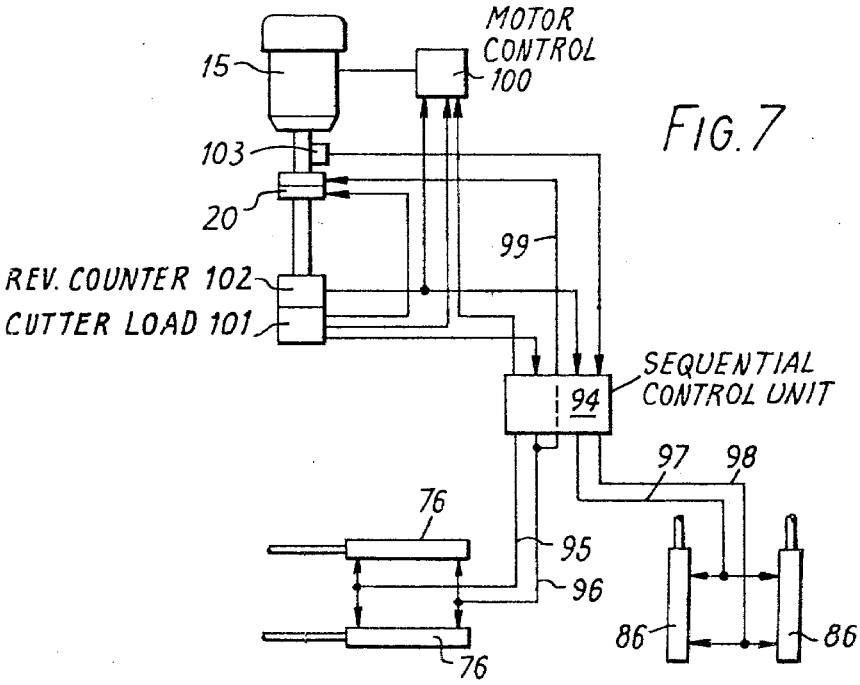
FIG. 7 is a schematic diagram showing in simplified form one possible arrangement of electropneumatic control system for effecting automatic shaft reversal and/or ejection of tramp material in a machine such as that shown in the other Figures.

Referring to FIG. 7, the control system is applicable to a shredder generally of the kind described above with reference to the other drawings, and includes an electro-pneumatic or electro-hydraulic sequential control unit 94 which may be of any suitable design for controlling the sequence of operations detailed below. In FIG. 7, the connections shown above the control unit 94 are electrical, whilst those below it are pneumatic. Thus the unit 94 controls the air or oil supply to the actuators 76 through lines 95,96 for respectively opening and closing the access door 74; and the air or oil supply to the jacks 86 through corresponding lines 97,98 respectively. A connection 99 is indicated by way of an interlock between the actuators 76 and the clutch 20, and is so arranged that the clutch can only normally be engaged when the access door 74 is closed. However, the unit 94 also incorporates a suitable over-ride means (not shown) whereby, when the hopper doors 80,81 are in their "closed" position, the clutch may be engaged so as to rotate the cutters whilst the access door 74 is open, provided step (2) in the sequence described below has been completed.

A switching unit 100 in the main power supply line to the motor 15 effects reversal of the motor in response to increases in torque above a predetermined level, as a result of increased resistance being encountered by the cutters in contact with material fed through the hopper 13. This torque is detected by a suitable transducer 101 incorporated in the drive between the motor and the cutters. The unit 100 is also controlled by a revolution counter 102, and is arranged to restore the motor 15 to forward running after the cutters have performed a predetermined fraction of a revolution or number of revolutions in reverse.

The control unit 94, also, is responsive to signals from the transducer 101 and counter 102, and in addition is responsive to signals from a further suitable transducer 103 which detects the change in motor output torque when the clutch 20 disengages. This will happen automatically under crash-stop conditions, i.e. when the force applied at the cutter tip during normal operation suddenly increases to a predetermined level substantially higher than that at which the response is to cause reversal of the motor. A typical sequence of operation, when abornal resistance to rotation, due to increased force applied to the cutters, is encountered, is as follows.

(1) If the resistance is less than "crash-stop" condition, but sufficient to activate unit 100 to reverse the motor, the motor is reversed and run forward repeatedly in an attempt to clear the obstruction.

(2) If after n-typically nine-reversals the resistance is still greater than the required amount, or if there is a "crash-stop" condition (in which latter case step (1) above would not apply), the control unit 94 operates the jacks 86 to close the hopper doors, and then the actuators 76 to open the access door 74.

(3) The control unit 94 now causes the motor, through the control unit 100, to perform a further sequence of reversals alternating with forward operation.

(4) The said forward operations in step (3) the obstruction has not been cleared, the motor is reversed a tenth time and stopped.

(5) If the obstruction is cleared in step (3) before the said reversals have been effected, or if the motor has been stopped in accordance with step (4), the motor is now run forward and the unit 94 immediately selects a mode of operation depending on whether the signal then received from transducer 101 is "normal" or "abnormal". If "normal", forward running is allowed to continue, the access door 74 is closed, and hopper doors 80,81 are opened.

(6) If however the signal is "abnormal", the control unit will cause the unit 100 to shut off the main power supply so that the machine can be inspected and the obstruction removed by hand through the access door 74.

It will be understood that, whilst the access door is open, in the majority of cases tramp material will automatically be ejected over the chute 71 during a reversal of the cutters of shaft 16 in step (3). The programme can of course be chosen to suit the user's requirements, and may be varied from the above sequence in any desired way; for example, in the case of an "abnormal" signal being received by the unit 94 at the end of step (5), steps (3) to (5) may be repeated until either the obstruction is cleared or the number of these repetitions has reached a predetermined value (counted by a suitable counter in control unit 94). In the latter case the machine will be closed down as in step (6).

So far as the machine itself is concerned, the cutters described herein are suitable for use in any machine of the kind hereinbefore specified, with or without a clutch. For example, the shafts may or may not be arranged for rotation at different speeds; the cutter shafts may have their axes in a common horizontal plane; there may be any desired number of cutters on each shaft; and any suitable arrangements for delivering material to the cutters for comminution, and for collecting it after comminution, may be provided.

We claim:

1. A rotary shredding machine comprising means for forming a comminuting chamber, an upper cutter shaft and a lower cutter shaft arranged for simultaneous contrarotation, each cutter shaft carrying disc-like cutters, said cutter shafts extending through said chamber means with cutters of one shaft being interleaved with those of the other shaft in a cutting zone between the shafts, a feed hopper above the chamber means, the chamber means having side exit means for opening in response to the presence of an intractable object above the cutting zone whereby such object can be ejected through the side exit means, said cutter shafts being disposed with their axes in spaced generally parallel relationship in a common plane inclined to the horizontal, said side exit means comprising an aperture and an access door, said aperture being in a side of said chamber means adjacent the cutters of said lower cutter shaft, said aperture being directed outwardly from and with respect to said chamber means in a direction generally transverse to the axis of said lower cutter shaft, said access door being openable and closable for opening and closing said aperture, and said shredding machine including means responsive to the nonrotation of said cutter shafts under crash stop conditions for effecting the opening of said access door.

2. The rotary shredding machine as defined in claim 1 including means for rotating said shafts in opposite directions with upper peripheral portions of said cutters traveling toward each other whereby heavy objects are impelled by the cutters of said upper cutter shaft toward said aperture.

3. The rotary shredding machine as defined in claim 2 including means for reversing the rotation of said cutter shafts to urge an intractable object away from the cutting zone, whereby such object in impelled by the cutters of said lower cutter shaft toward said aperture.

4. The rotary shredding machine as defined in claim 2 including a hopper door for generally opening and closing across a path of travel for material traveling from said feed hopper to said chamber means, and means responsive to the nonrotation of said cutter shafts under crash stop conditions for effecting the closing motion of said hopper door.

5. The rotary shredding machine as defined in claim 2 including at least one hopper door internally of said feed hopper, said at least one hopper door being movable between a first position clear of a path of travel of material from said feed hopper to said chamber means and toward said cutters and a second position at least partially obstructing said path of travel, and actuating means for moving said at least one hopper door between said first and second positions, and said actuating means being disposed generally externally of said feed hopper but having a portion passing through a slot in said feed hopper and being connected to said at least one hopper door.

6. The rotary shredding machine as defined in claim 1 including a hopper door for generally opening and closing across a path of travel for material traveling from said feed hopper to said chamber means, and means responsive to the nonrotation of said cutter shafts under crash stop conditions for effecting the closing motion of said hopper door.

7. The rotary shredding machine as defined in claim 6 including at least one hopper door internally of said feed hopper, said at least one hopper door being movable between a first position clear of a path of travel of material from said feed hopper to said chamber means and toward said cutter and a second position at least partially obstructing said path of travel, and actuating means for moving said at least one hopper door between said first and second positions, and said actuating means being disposed generally externally of said feed hopper but having a portion passing through a slot in said feed hopper and being connected to said one hopper door.

8. The rotary shredding machine as defined in claim 1 including at least one hopper door internally of said feed hopper, said at least one hopper door being movable between a first position clear of a path of travel of material from said feed hopper to said chamber means and toward said cutters and a second position at least partially obstructing said path of travel, and actuating means for moving said at least one hopper door between said first and second positions, and said actuating means being disposed generally externally of said feed hopper but having a portion passing through a slot in said feed hopper and being connected to said at least one hopper door.

9. The rotary shredding machine as defined in claim 1 including means responsive to a predetermined torque on at least one of said cutter shafts to reverse the rotation of said shafts without opening said access door, and means responsive to another predetermined torque greater than said first-mentioned predetermined torque to stop the rotation of said cutter shafts and effect the opening of said access door.

* * * * *